US008747187B2

(12) United States Patent
Lemaire et al.

(10) Patent No.: US 8,747,187 B2
(45) Date of Patent: Jun. 10, 2014

(54) METHOD FOR SHAPING AN OPHTHALMIC LENS FOR EYEGLASSES

(75) Inventors: Cédric Lemaire, Charenton-le-Pont (FR); Philippe Pinault, Charenton-le-Pont (FR); David Tang, Charenton-le-Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 711 days.

(21) Appl. No.: 13/089,662

(22) Filed: Apr. 19, 2011

(65) Prior Publication Data

US 2011/0256804 A1 Oct. 20, 2011

(30) Foreign Application Priority Data

Apr. 20, 2010 (FR) ..... 10 01677

(51) Int. Cl.
*B24B 47/22* (2006.01)

(52) U.S. Cl.
USPC ..... 451/5; 451/44; 451/65; 451/71; 451/255; 451/256

(58) Field of Classification Search
CPC ..... B24B 47/225; B24B 9/14; B24B 9/142; B24B 9/144; B24B 9/146; B24B 9/148; B24B 13/005; B24B 13/0006; B24B 13/0012; B24B 13/0018; B24B 13/0025; B24B 13/0037
USPC ..... 451/5, 11, 41, 44, 58, 69, 70, 71, 255, 451/256
See application file for complete search history.

(56) References Cited

U.S. PATENT DOCUMENTS

| | | | | |
|---|---|---|---|---|
| 3,267,617 | A * | 8/1966 | Volk | 451/251 |
| 5,450,335 | A * | 9/1995 | Kikuchi | 702/168 |
| RE35,898 | E * | 9/1998 | Shibata et al. | 451/5 |
| 6,099,383 | A * | 8/2000 | Mizuno et al. | 451/5 |
| 6,419,570 | B1 * | 7/2002 | Werner | 451/390 |
| 6,572,451 | B1 * | 6/2003 | Fujita et al. | 451/42 |
| 6,984,161 | B2 * | 1/2006 | Suzuki et al. | 451/5 |

(Continued)

FOREIGN PATENT DOCUMENTS

| | | | |
|---|---|---|---|
| EP | 1 974 855 | A1 | 10/2008 |
| WO | 2007/012713 | A1 | 2/2007 |
| WO | 2008/043910 | A1 | 4/2008 |

OTHER PUBLICATIONS

French Search Report, dated Oct. 29, 2010, from corresponding French application.

*Primary Examiner* — George Nguyen
(74) *Attorney, Agent, or Firm* — Young & Thompson

(57) ABSTRACT

A method of shaping an ophthalmic lens to have a desired outline with a machining device including a blocking support for the ophthalmic lens and at least one first machining tool, the method includes:

obtaining an inner cutting limit for the first machining tool;

defining an initial blocking position for the ophthalmic lens and its desired outline;

calculating whether at least a portion of the desired outline presents a non-zero intersection with the inner cutting limit;

defining as the final blocking position either the unchanged initial blocking position if the calculated intersection is zero, or else a blocking position that is modified relative to the initial blocking position so that the desired outline as repositioned using the modified blocking position does not present an intersection with the inner cutting limit associated with the first tool; and blocking and shaping the ophthalmic lens with the desired outline.

14 Claims, 3 Drawing Sheets

(56) References Cited

U.S. PATENT DOCUMENTS

| | | | | |
|---|---|---|---|---|
| 7,617,579 | B2 * | 11/2009 | Natsume | 29/26 A |
| 8,133,095 | B2 * | 3/2012 | Lemaire et al. | 451/43 |
| 8,342,909 | B2 * | 1/2013 | Lemaire et al. | 451/11 |
| 2001/0051490 | A1 * | 12/2001 | Siders et al. | 451/5 |
| 2004/0097168 | A1 | 5/2004 | Igarashi et al. | |
| 2004/0142642 | A1 * | 7/2004 | Thepot et al. | 451/43 |
| 2008/0026679 | A1 * | 1/2008 | Siders et al. | 451/42 |
| 2008/0274672 | A1 * | 11/2008 | Cole et al. | 451/41 |
| 2010/0093265 | A1 | 4/2010 | Lemaire et al. | |
| 2010/0184356 | A1 * | 7/2010 | Haddadi et al. | 451/5 |
| 2011/0250823 | A1 * | 10/2011 | Paillet et al. | 451/5 |

* cited by examiner

METHOD FOR SHAPING AN OPHTHALMIC LENS FOR EYEGLASSES

TECHNICAL FIELD TO WHICH THE INVENTION RELATES

The present invention relates to a method of shaping an ophthalmic lens to have a desired outline in order to enable it to be mounted in an eyeglass frame. The invention relates more precisely to determining a blocking position for the lens on a blocking support on which the lens is held while it is being shaped.

The method is particularly adapted to shaping an ophthalmic lens having an outline that presents a shape that is complex, in particular that includes zones of negative curvature.

TECHNOLOGICAL BACKGROUND

An ophthalmic lens is prepared for mounting in a rimmed, half-rimmed, or rimless (or "drilled") eyeglass frame by acquiring the desired outline along which the ophthalmic lens is to be shaped so as to adapt it to the shape of the eyeglass frame. The outline is positioned on the lens as a function of the optical frame of reference of the lens so that, while it is being worn, the lens is suitably positioned in front of the wearer's eye. The lens is then shaped to match the desired outline.

During shaping, it can happen that certain portions of the desired outline cannot be shaped without the tool carrier or the tool coming into conflict with some other element of the machining device, e.g. the blocking support for supporting the lens in the machining device. This typically happens when the corresponding portion of the desired outline is situated close to the lens support or when the diameter of the tool is substantially smaller than the diameter of the tool carrier.

Ophthalmic lenses that are to be shaped with outlines of small height and large width, generally rectangular outlines, often give rise to this type of interference.

The same applies to ophthalmic lenses that are to be shaped with outlines presenting shapes that are complex, e.g. including zones curved in towards the center of the lens, referred to as zones of negative curvature. These zones of negative curvature generally correspond to decorative details in the outline of the lens and they need to be machined by a tool presenting a diameter that is smaller than the diameter of the grindwheel commonly used for shaping the lens. Under such circumstances, it is possible to use a cutter tool presenting a diameter of at few millimeters, for example.

SUMMARY OF THE INVENTION

To solve this problem, the invention proposes a method of shaping an ophthalmic lens for eyeglasses to have a desired outline by means of a machining device including a blocking support for the ophthalmic lens and at least one first machining tool that is rotatable about a first axis that is movable relative to the blocking support, the method comprising the steps of:

a) obtaining an inner cutting limit of said first tool, defined in a frame of reference of the shaper device;

b) defining an initial blocking position for the lens and its desired outline on the blocking support in the frame of reference of the shaper device;

c) calculating whether at least a fraction of the desired outline, when positioned using the initial blocking position, presents a non-zero intersection with the inner cutting limit associated with the first tool;

d) defining as a final blocking position, either the initial blocking position without change if the intersection calculated in step c) is zero, or else, a blocking position that is modified relative to the initial blocking position so that the desired outline as repositioned to the modified blocking position does not present any intersection with the inner cutting limit associated with the first tool;

e) blocking the lens on a blocking support in the final blocking position; and f) shaping the lens with the desired outline using at least the first tool.

The inner cutting limit is defined around the blocking support and it corresponds to the zone around said support to which the machining tool under consideration cannot gain access because of the risk of the tool (or the tool carrier) interfering with the blocking support.

Thus, by means of the invention, even before the blocking support is put into place on the lens (generally at the optical center or the boxing center of the lens), it is possible to detect any risk of interference between the machining tool and the blocking support.

If such a risk is detected, it is then possible to modify the position at which the blocking support is to be fastened on the lens so that while the lens is being shaped the tool under consideration has no need for access inside the inner cutting limit.

Advantageously:

the machining device has a plurality of tools, and at least two distinct tools are selected, including said first tool and at least one other tool rotatable about an axis that is movable relative to the blocking support, each tool being for shaping a portion associated therewith of the desired outline;

in step a), obtaining, for each tool, an inner cutting limit defined in a frame of reference of the shaper device, the inner cutting limit of the first tool being distinct from that of the other tool;

in step c), calculating, for each tool, whether the portion that is associated therewith of the desired outline, as positioned using the initial blocking position, presents any non-zero intersection with the inner cutting limit associated with the tool under consideration;

in step d), defining as the final blocking position, either the unchanged initial blocking position if the intersections calculated in step c) are zero, or else a blocking position that is modified relative to the initial blocking position so that the desired outline as repositioned using the modified blocking position does not present any intersection with the inner cutting limits that are associated respectively with the different tools; and in step f), shaping the lens with the desired outline using the different tools, a first portion of the desired outline being shaped with said first tool, and the other portion of the desired outline being shaped with said other tool.

Preferably, if the intersection calculated in step c) is non-zero, step d) comprises the following substeps:

d1) determining an alternative blocking position different from the initial blocking position;

d2) calculating, for each tool and for said alternative blocking position, whether at least a portion of the desired outline as repositioned using said alternative blocking position presents a non-zero intersection with the inner cutting limit associated with the tool under consideration; and d3) repeating steps d1) and d2) so long as step d2) gives a non-zero intersection result.

In a variant, if the intersection calculated in step c) is non-zero, step d) comprises the following substeps:

d'1) determining a plurality of alternative blocking positions different from the initial blocking position;

d'2) calculating, for each tool and for each alternative blocking position, whether at least a portion of the desired outline as positioned using the alternative blocking position under consideration presents a non-zero intersection with the inner cutting limit associated with the tool under consideration; and d'3) selecting the modified blocking position from said alternative blocking position.

According to a particularly advantageous characteristic of the method of the invention when applied to an ophthalmic lens for being drilled or notched by means of a second machining tool in order to be mounted on a rimless frame, there are provided:

a step of obtaining an inner cutting limit of said second machining tool defined in a frame of reference associated with the machining device;

a step of acquiring the positions of the edges of the notches or of the drill holes in the frame of reference of the desired outline;

between steps d) and e), a calculation step of detecting whether, when the desired outline is repositioned at the final blocking position, the edges of the notches or drill holes present an intersection with the inner cutting limit associated with said second tool; and if an intersection is detected, a step of determining a new final blocking position distinct from said final blocking position and such that firstly the desired outline, when repositioned using the new final blocking position, does not present any intersection with the inner cutting limit associated with the second tool, and secondly the edges of the notches or drill holes do not present any intersection with said inner cutting limit.

Other characteristics of the method in accordance with the invention that are advantageous and non-limiting are as follows:

in step d), the modified blocking position is defined from amongst the alternative blocking positions as the blocking position of the lens on the blocking support that is the closest to the initial blocking position or to the center of gravity of the desired outline;

in step c), the radius segment is calculated around the initial blocking point that is situated inside said intersection and that presents the greatest length, and wherein, in step d), the modified blocking position is the result of shifting the position of the initial blocking position in the direction of said radius segment;

said shift is through a distance equal to the length of said radius segment;

for step c) giving as its result at least two non-zero intersections between the desired outline and the inner cutting limit of at least one tool, there is calculated, for each intersection found, the radius segment about the initial blocking point that is situated inside the intersection under consideration and that presents the greatest length, and wherein, in step d), the modified blocking position results from at least one combination of shifts of the initial blocking position along the directions of said radius segments respectively associated with said at least two intersections;

the inner cutting limit of each tool depends on the shape of a tool carrier carrying the tool under consideration during shaping, and on the shape of the blocking accessories of the lens;

the inner cutting limit of each tool depends on the angle formed between the axis of rotation of the tool under consideration and a blocking axis of the lens about which the lens turns relative to the tools while it is being shaped in step f);

the inner cutting limit of each tool is obtained from a registry in which each record contains an identifier of a tool and an inner cutting limit associated with the tool; and for steps a) to d) being implemented by a calculation device distinct from the machining device, provision is made between steps d) and f) for a step of transmitting the final blocking position from the calculation device to the machining device.

DETAILED DESCRIPTION OF AN EMBODIMENT

The following description with reference to the accompanying drawings, given by way of non-limiting example, makes it easily understood what the invention consists in and how it can be put into practice.

In the following description, the term "envelope" is used to designate the surface that defines a volume under consideration. The envelope of a moving article designates in particular the surface that circumscribes all of the positions occupied by that article while performing the movement under consideration.

The technical portion of an optician's profession consists in mounting a pair of ophthalmic lenses on a frame selected by the future wearer of the pair of eyeglasses.

Such mounting comprises four main operations:

acquiring a desired outline along which each ophthalmic lens is to be shaped;

centering the desired outline in the frame of reference of the corresponding lens, which consists in determining the position that each lens will occupy on the frame so as to be appropriately centered in front of the pupil of the wearer's eye in order to perform appropriately the optical function for which it is designed;

blocking each lens, which consists in fastening a blocking accessory on each lens to enable the machining device to take hold of the lens and to retain the reference position of said lens; and shaping each lens, which consists in machining it or cutting it along the desired outline, given the defined centering parameters.

The shaping operation is generally performed in three successive steps, namely: blanking; finishing; and superfinishing. The blanking step consists in bringing the initial outline of the lens to an outline that is close to or identical with the desired outline. The finishing operation consists in beveling the edge face of the lens if it is to be mounted on a rimmed eyeglass frame, or in grooving the edge face of the lens if it is to be mounted on a half-rimmed eyeglass frame. The super finishing step consists, where necessary, in polishing and chamfering the sharp edges of the edge face of the lens. The shaping method of the invention applies here to all of these steps.

The Ophthalmic Lens

Figure 2:
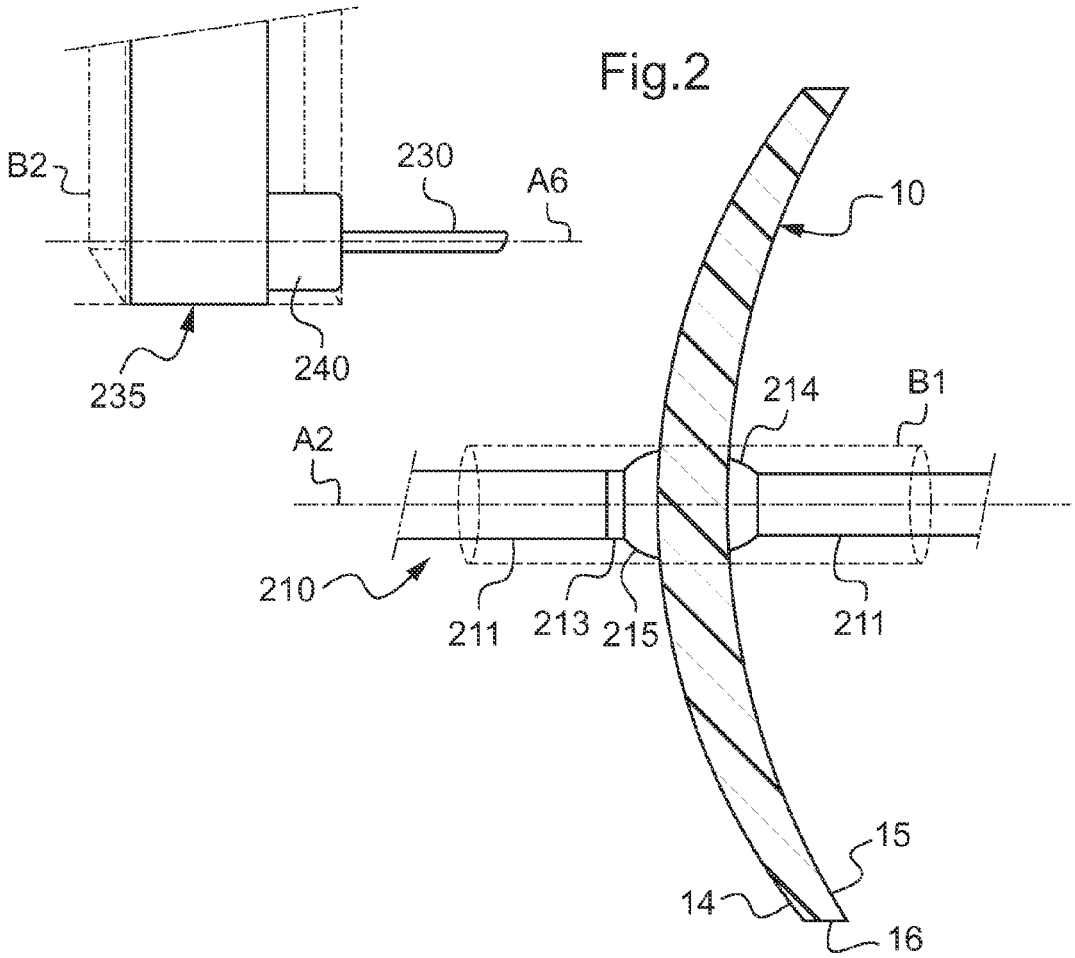
FIG. 2 is a diagrammatic section view of an ophthalmic lens held by a lens support and ready to be shaped by a cutter.

In FIG. 2, there can be seen an ophthalmic lens 10. Such an ophthalmic lens 10 presents two optical faces, a front face 14 and a rear face 15, together with an edge face 16 that is initially circular and that needs to be brought to the shape of the desired outline so that the ophthalmic lens can then be fastened to the selected eyeglass frame.

Figure 3:
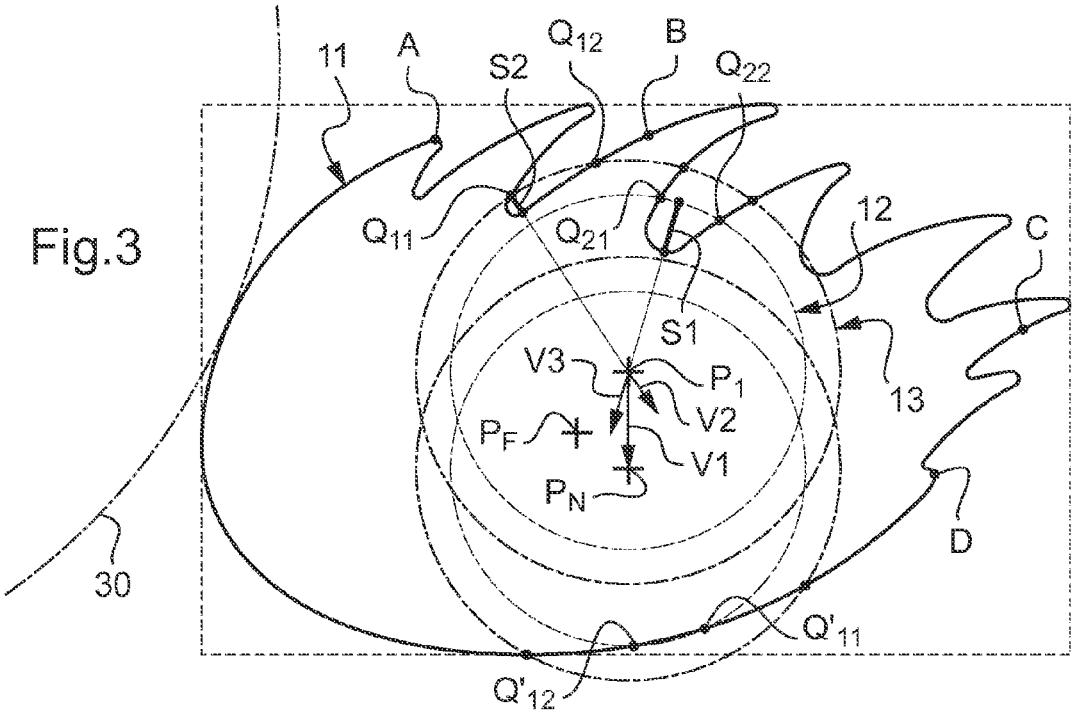
FIG. 3 is a diagrammatic view of a desired outline along which the ophthalmic lens is to be shaped.

FIG. 3 shows a particular example of a desired outline 11. Naturally, the method of the present invention applies to any type of outline whether regular or otherwise. Nevertheless, it applies in particularly advantageous manner to ophthalmic lenses for shaping with desired outlines that are of irregular shapes, and for assembling with eyeglass frames of the drilled type (in which the temples and the bridge of the frame include means for fastening in holes drilled in the lenses).

In FIG. 3, the desired outline 11, considered in projection onto a general mean plane of the ophthalmic lens prior to being shaped, comprises a regular bottom sector and a top sector A-D that is irregular. This top sector is made up of a plurality of complex regions defined respectively by points A, B, C, and D.

Each complex region A-B, B-C, C-D has one or more zones with negative curvature. These negative curvature zones are zones in which the desired outline 11 is concave.

FIG. 3 also shows the boxing rectangle for the desired outline 11, corresponding to the rectangle in which the desired outline 11 is inscribed having two sides that define the horizon axis of the outline. The center of this rectangle, called the boxing center, thus forms the origin of the frame of reference for the ophthalmic lens.

The midplane of the ophthalmic lens is defined as the plane containing the rear circular edge of the lens before it is shaped. The desired outline 11 then corresponds to the projection onto said midplane of the three-dimensional outline along which the lens is to be shaped.

The Machining Device

In order to shape said ophthalmic lens 10, it is placed in a machining device 200 that itself known, such as the device described in document WO 2008/043910.

Figure 1:
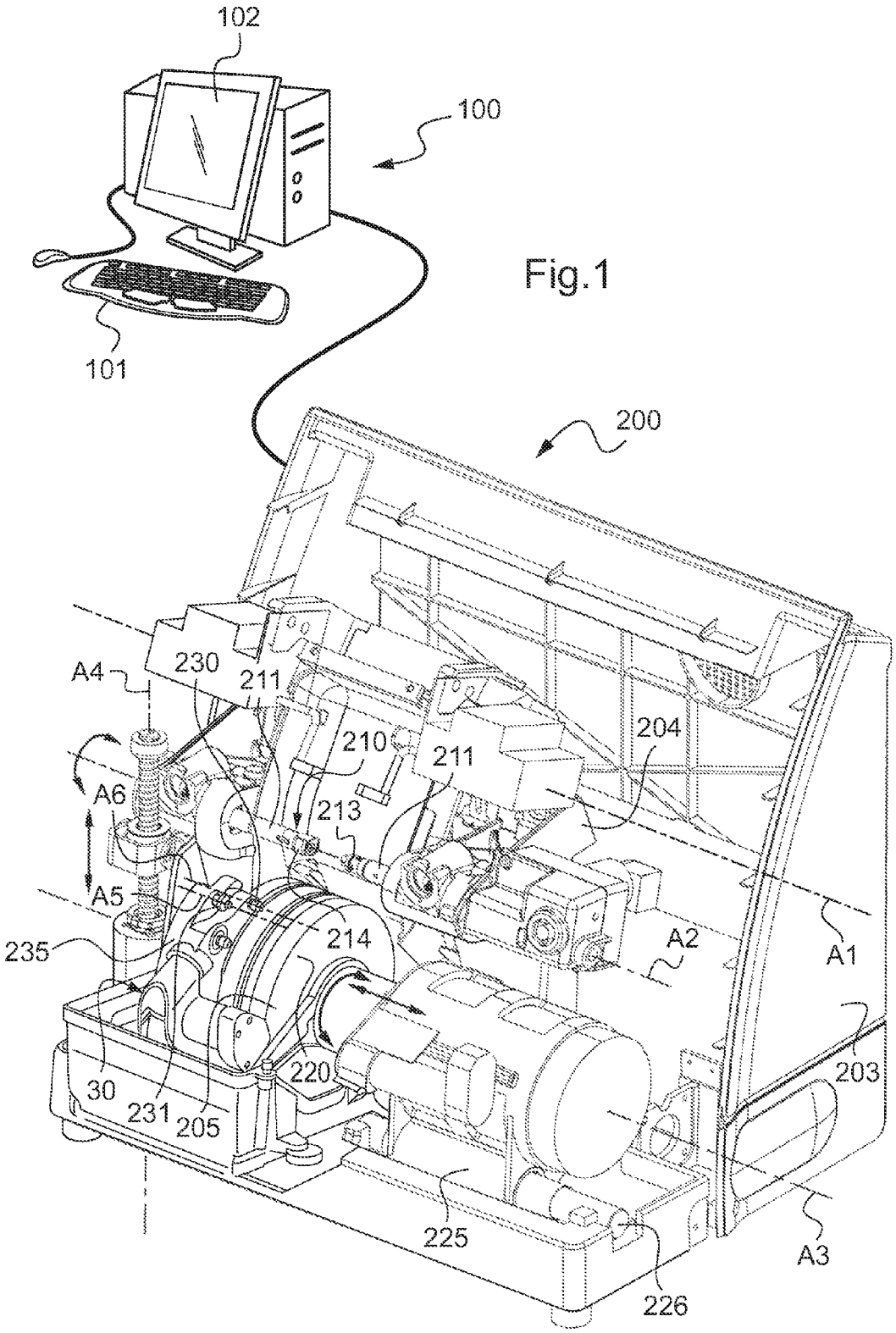
FIG. 1 is a diagrammatic perspective view of a shaper device used for implementing the method of the invention.

Such a device, as shown in FIGS. 1 and 2, is a grinder that comprises:

- a rocker 204 mounted to pivot about a rocker axis A1, in practice a horizontal axis, on a structure 203, and it includes support means 210 for supporting the ophthalmic lens 10 enabling the lens to be put into motor-driven rotation about a blocking axis A2 that is substantially perpendicular to the midplane of the lens and parallel to the axis A1;
- a set of large-diameter grindwheels comprising in particular a large grindwheel 220 mounted on the structure 203 to turn under motor drive about a grindwheel axis A3 parallel to the rocker axis A1;
- a finishing module 235 carrying a plurality of finishing tools, including a small wheel 231 and a cutter 230 mounted to rotate about axes A5 and A6 that are parallel to the rocker axis A1, the blocking axis A2, and the grinder axis A3, the module being mounted to pivot about the grinder axis A3 to control the positions of its finishing tools relative to the lens; and
- a calculation and control device 100 serving in particular to control the various degrees of freedom of the grinder device 200, and here including a keyboard 101 and a screen 102 for displaying a graphics interface.

Typically, the calculation and control device 100 is incorporated in the electronic or computer system of the grinder 200.

The support means 210 for supporting the ophthalmic lens 10 here comprise more precisely two shafts 211 for gripping and driving in rotation the ophthalmic lens 10 that is to be shaped. These two shafts 211 are in alignment with each other along the blocking axis A2.

Each of these shafts 211 possesses a free end that faces the other free end, one of which ends is fitted with a blocking chuck 214 for blocking the ophthalmic lens 10 and the other of which is fitted with receiver means 213 for receiving a lens blocking accessory 215 (prepositioned on the lens at the time it is blocked).

The blocking accessory is conventionally positioned on the ophthalmic lens at a given point and with a given orientation, thereby enabling the position of the frame of reference of the ophthalmic lens to be identified relative to the frame of reference of the structure 203 of the machining device 200. Conventionally, this blocking accessory 215 comprises a body that is arranged to co-operate with the corresponding shaft 211 of the grinder 200, and an adhesive pellet arranged to be stuck on the optical front face 14 of the ophthalmic lens.

As shown in FIG. 2, while machining the ophthalmic lens 10, central portions of its front and rear optical faces 14 and 15 are covered by the blocking chuck 214 and the blocking accessory 215. It is then possible to define around the blocking axis A2 a surface that is referred to as the inaccessibility envelope B1, within which surface it is not possible to machine the ophthalmic lens 10. Since the blocking chuck 214 and the blocking accessory 215 in this example both present the same outline of known transverse size (typically a circular outline of known diameter or a rectangular outline of known sides), the inaccessibility envelope B1 is defined as the circular cylinder about the blocking axis A2 that presents a diameter equal to the diameter of the blocking chuck 214 and the blocking accessory 215 (or slightly greater than said diameter, given possible deformation of said blocking chuck and accessory).

A first one of the two shafts 211 is stationary in translation along the blocking axis A2. In contrast, the second one of the two shafts 211 is movable in translation along the blocking axis A2 to apply clamping in axial compression on the ophthalmic lens 10 between the two shafts.

The large grindwheel 220 is a conventional grindwheel, having a cutting surface that, on rotating about the axis A3, defines a cutting envelope surface of revolution around said axis A3, presenting a diameter that is greater than or equal to 80 millimeters, e.g. equal to 155 millimeters.

The small wheel 231 is a grindwheel of smaller diameter than the grindwheel 220, and it has a cutting surface that, in its rotation about the axis A5, defines a cutting envelope surface of revolution about said axis A5, which surface preferably presents a diameter of less than 80 millimeters, e.g. equal to 11 millimeters.

The cutter 230 has a cutting edge that, in its rotation about the axis A6, defines a cutting envelope surface of revolution about the axis A6, which surface presents a diameter less than 10 millimeters, and preferably less than 5 millimeters, e.g. equal to 1.4 millimeters.

These three tools 220, 230, and 231 are carried by tool carriers.

The large grindwheel 220 and the small wheel 231 are carried respectively by a shaft and by a mandrel. They have diameters that are much greater than the diameters of said shafts and said mandrels. While machining the lens, these tool carriers thus do not risk interfering with the shafts 211 for blocking the ophthalmic lens.

In contrast, as shown in FIG. 2, the cutter 230 is carried by a mandrel 240, itself supported by the finishing module 235, which mandrel presents dimensions (transverse relative to the axis A6) that are greater than the dimensions of the cutter. In this example, and more precisely, the cutter 230 is positioned on the finishing module 235 in such a manner that there is a danger of the finishing module interfering with the shafts 211 for blocking the ophthalmic lens.

Consequently, it is possible to define around said finishing module 235 a surface, referred to as the safety envelope B2, within which the mandrel 240 and the finishing module 235 are contained.

In comparison, the safety envelopes of the large grindwheel 220 and of the small wheel 231 are formed by their cutting envelopes since their tool carriers have no risk of interfering with the shafts 211 for blocking the ophthalmic lens.

It can thus be understood that while machining the ophthalmic lens, the safety envelope B2 must never intersect the inaccessibility envelope B1, firstly to avoid any risk of machining the blocking chuck 214 and the blocking accessory 215, and secondly to avoid any risk of interference between the tool in question (or the tool carrier) and the shafts 211 for blocking the ophthalmic lens.

Given those two envelopes B1 and B2, it is possible to define around the blocking axis A2 a limit that is referred to as the inner cutting limit 12, 13 (see FIG. 3), which limit defines the volume into which the tool in question cannot penetrate in order to machine the edge face 16 of the ophthalmic lens 10. In other words, this inner cutting limit 13, 14 corresponds to the envelope in which the cutting surface of the tool in question moves while moving around the shafts 211 for blocking the lens in an allowable range of operating movements.

Since the safety envelopes B2 of the tools are different, it can be understood that each tool is associated with its own inner cutting limit 12, 13.

As shown in FIG. 3, i.e. in projection on the mean plane of the ophthalmic lens 10, the inner cutting limits 12 associated with the grindwheel 220 and with the small wheel 231 coincide. They present shapes that are cylinders of revolution about the blocking axis A2, of diameter equal to the diameter of the inaccessibility envelope B1.

The inner cutting limit 13 associated with the cutter 230 also presents the shape of a cylinder of revolution about the blocking axis A2, but it presents a diameter that is greater than the diameter of the inaccessibility envelope B1.

Since these inner cutting limits 12 and 13 are of shapes that are constant, provision can be made to store their characteristics in a registry of the calculation and control device 100 so that on starting the grinder 200, the calculation and control device 100 can acquire these characteristics.

More generally, when the lens can be blocked with blocking accessories of different shapes (larger or smaller depending on the slippery nature of the lens), each inner cutting limit is then not only associated with a tool, but also with a type of blocking accessory.

Method of Choosing a Tool

Since the desired outline 11 for the ophthalmic lens 10 for shaping includes complex regions A-B, B-C, and C-D, as shown in FIG. 3, the shaping of the lens cannot be performed using solely the grindwheel 220. The diameter of the grindwheel 220 is too great to comply with the shape of the desired outline 11 in its zones of negative curvature that present excessive concavity.

Shaping can then only be performed using the cutter 231. Nevertheless, using a small-diameter tool is more burdensome than using a large-diameter tool. Thus, a plurality of tools are used in this example for machining the ophthalmic lens 10 to have the desired outline 11.

Thus, before beginning to machine said lens, the calculation and control device 100 determines which regions of the desired outline 11 of the ophthalmic lens 10 are to be machined by which one of the tools 220, 230, 231, as a function of the geometrical characteristics of the desired outline 11 and as a function of the diameters of the cutting envelopes of those tools 220, 230, and 231.

For this purpose, the calculation and control device 100 begins, in one way or another, by acquiring the desired outline 11.

By way of example, the desired outline 11 may be obtained merely by performing a search in a database registry for a record that is associated with the reference for the selected eyeglass frame and that stores the desired outline. Nevertheless, a regularly updated database registry is then needed.

More conventionally, the desired outline 11 may be obtained by taking a digital picture of the presentation eyeglass lens that the optician has available, and by processing the picture to determine the two-dimensional coordinates of a set of points that characterize the shape of the edge faces of the lenses of the presentation eyeglass frame.

The desired outline 11 may also be obtained by feeling the edge faces of the lenses of said presentation frame using a conventional reader, such as that described in patent EP 0 750 172 or sold by Essilor International under the trademark Kappa or under the trademark Kappa CT. After such a feeling operation, the calculation and control device 100 will have thus acquired the two-dimensional coordinates of a plurality of points that characterize the shape of the desired outline 11.

Whatever the method used for acquiring the desired outline, the calculation and control device 100 then performs an algorithm for analyzing the desired outline 11 in order to determine a first region of the desired outline 11 that has points of the outline for which it is possible to use the grindwheel 220 in order to shape the ophthalmic lens without damaging the shape of the desired outline.

More precisely, the algorithm consists in isolating the points of the desired outline 11 at which it is possible to machine the lens 10 with the large grindwheel 220 in order to reach the desired radius dimension for the lens at the point in question without paring away other portions of the lens situated inside the desired outline 11.

As shown in FIG. 3, for each point of the set of points modeling the desired outline 11, the algorithm calculates for this purpose the position of the cutting envelope 30 of the grindwheel 220 when it is tangential to the outline at said point. This position corresponds to the position of the grindwheel 220 when it is in position for machining the lens 10 to have the desired outline 11 at this point. The algorithm then searches for points of the desired outline 11 that lie inside this first cutting envelope, i.e. that are situated on the side of the circular arch corresponding to the grindwheel 220, should any such points exist. These points correspond to additional points pared away by the grindwheel 220 while machining the lens 10 at the point under consideration of the desired outline 11. The algorithm can thus determine the complex sectors of the outline in which it is not possible to use the grindwheel 220. For the desired outline 11 shown in FIG. 3, this sector corresponds to the top sector of the desired outline 11, lying between the points A and D.

The algorithm then verifies whether all of this top sector can be machined using the wheel 231.

For this purpose, the algorithm proceeds in the same manner as with the grindwheel 220, this time taking into consideration only the points in the top sector of the desired outline 11. The algorithm can thus determine the complex regions of the desired outline 11 in which using the wheel 231 is not possible. With the desired outline 11 that is shown in FIG. 3, these complex regions lie between the points A and B and also between the points C and D.

Finally, the algorithm verifies whether these two complex regions A-B and C-D can be machined using the cutter 230. If this is not possible, then it displays an error message on the screen 102, informing the optician that it is not possible to shape the ophthalmic lens.

Otherwise, if both complex regions A-B and C-D can be machined using the cutter 230, then the calculation and control device 100 stores the following information:

- the bottom sector of the ophthalmic lens 10 is to be shaped using the grindwheel 220;
- the complex regions A-B and C-D are to be shaped using the cutter 231; and
- the complex region B-C is to be shaped using the wheel 230.

Determining the Blocking Point

This consists in determining whether, by blocking the lens at its boxing center $P_1$, it is possible to shape the ophthalmic lens 10 to have its desired outline 11 using the intended tools, and if it is not possible, it consists in offsetting the blocking point of the lens from the boxing center $P_1$ until a final blocking position $P_F$ is found in which the shaping is possible.

Figure 4:
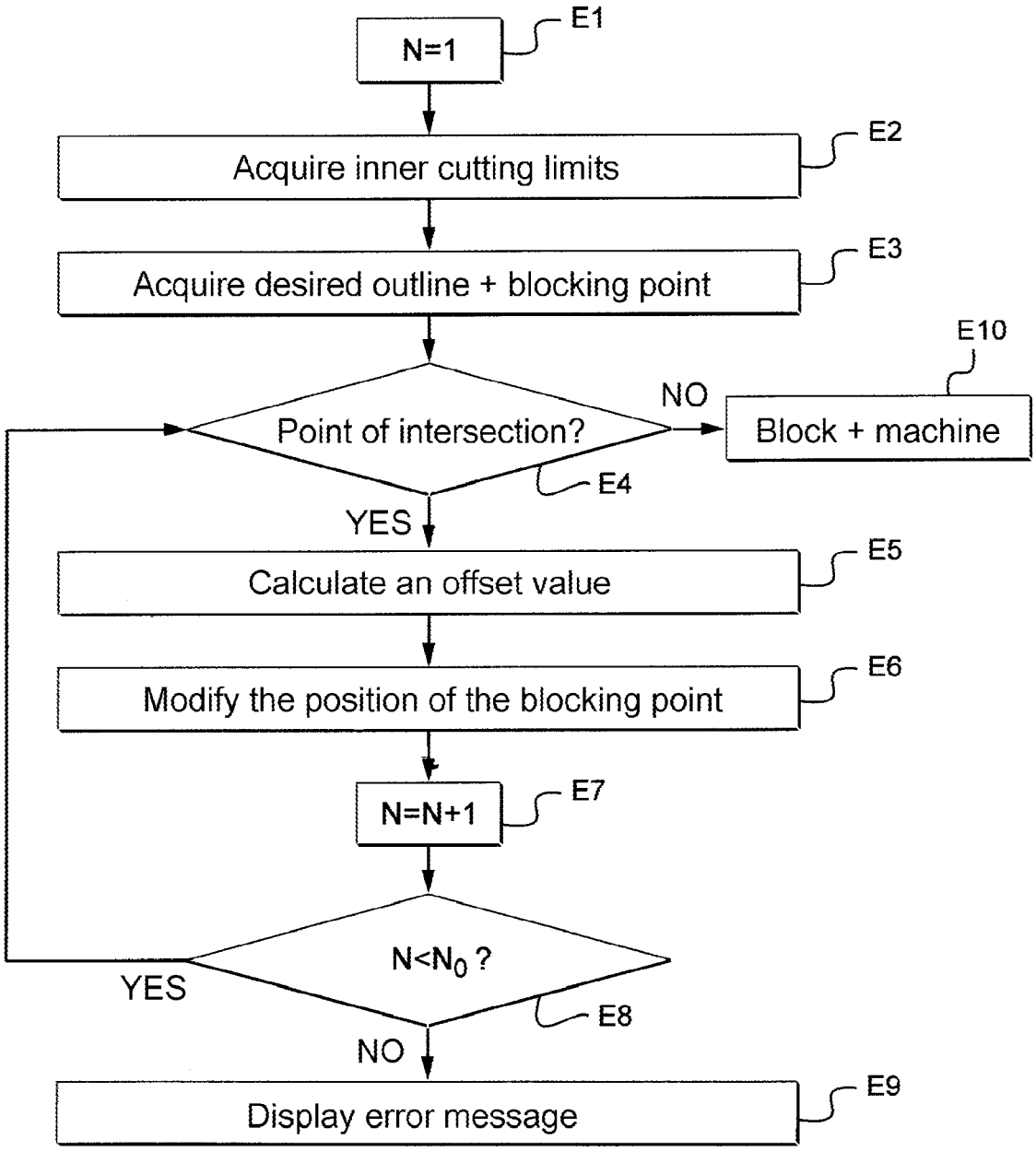
FIG. 4 is a flow chart showing the algorithm implemented by the method of the invention.

The algorithm implementing this method of searching for a final blocking position $P_F$ comprises successive steps as shown in FIG. 4.

In a first step E1, the calculation and control device 100 reinitializes a counter. The value N stored in the counter is then equal to 1.

During a second step E2, the calculation and control device 100 searches the database registry to which it has access firstly for the inner cutting limit 12 associated with the grindwheel 220 and with the wheel 231, and secondly for the inner cutting limit 13 associated with the cutter 230.

During a third step E3, described in detail above, the calculation and control device 100 acquires the two-dimensional coordinates of the points that characterize the desired outline 11, and then it calculates the position of the boxing center $P_1$.

During a fourth step E4, the calculation and control device 100 determines whether at least a portion of the desired outline 11 that is to be machined using the grindwheel 220 or the wheel 231 presents a non-zero intersection with the inner cutting limit 12 and whether at least a portion of the desired outline 11 for being machined using the cutter 230 presents a non-zero intersection with the inner cutting limit 13.

For this purpose, the calculation and control device 100 superposes the inner cutting limits 12 and 13 on the desired outline 11 in such a manner that the centers of the circles representative of the inner cutting limits 12 and 13 coincide with the boxing center $P_1$. This simulates blocking the ophthalmic lens 10 at its boxing center $P_1$.

The device then solves two systems of equations to find any points of intersection between the desired outline 11 and those circles. In those two systems of equations, the first equation corresponds to the equation of the desired outline 11. In contrast, the second equation corresponds, in the first system, to the equation of the circle representing the inner cutting limit 12, and in the second system it corresponds to the equation of the circle representing the inner cutting limit 13.

In FIG. 3, it can be seen that a fraction $Q_{11}$-$Q_{12}$ of the complex portion A-B that is to be shaped using the cutter 230 lies inside the inner cutting limit 13. It can also be seen that a fraction $Q_{21}$-$Q_{22}$ of the complex portion B-C that is to be shaped by the wheel 231 lies inside the inner cutting limit 12. It can thus be understood that by placing the blocking accessory 215 on the ophthalmic lens 10 in such a manner that it is centered on the boxing center $P_1$, an interference problem will occur while machining the lens between the shafts 211 for blocking the lens and the tools or tool carriers of the grinder 200.

The calculation and control device 100 therefore suspends blocking of the ophthalmic lens 10 in order to find a new blocking position $P_N$ that is modified relative to the boxing center $P_1$, in the hope of finding a position in which the desired outline 11 no longer presents any intersection with the inner cutting limits 12 and 13.

During a fifth step E5, the calculation and control device 100 calculates an offset vector V1 that enables the blocking point to be offset into a position that is capable of solving the above-mentioned interference problems.

For each intersection zone $Q_{11}$-$Q_{12}$, $Q_{21}$-$Q_{22}$, the calculation and control device 100 identifies the radius segments S1, S2 of the circle representing the inner cutting limits 12, 13 associated with said intersection zone and that is situated between the desired outline 11 and said circle, and that presents the greatest length.

It then determines the coordinates of two offset vectors V2, V3 that are oriented in the opposite direction to said radius segments S1, S2 and that present lengths identical to the lengths of the radius sectors S1, S2. It thus deduces therefrom the coordinates of the offset vector V1 which is equal to the sum of the two offset vectors V2 and V3.

During a sixth step E6, the calculation and control device 100 proceeds to offset the position of the blocking point from the boxing center $P_1$ to the new blocking point $P_N$, along said offset vector V1.

This offset of the blocking point thus makes it possible to ensure that no intersection remains between the zones $Q_{11}$-$Q_{12}$, $Q_{21}$-$Q_{22}$ under consideration of the desired outline 11 and the inner cutting limits 12, 13.

Naturally, it would also be possible to provide a predetermined safety margin, consisting in offsetting the blocking point along a vector of identical direction but of modulus that is slightly greater than that of the offset vector V1.

In a variant, the offset vector may be calculated differently. For example, provision may be made for it to be of a length that is identical to the length of the vector V1, but for it to have a different orientation. For example, its orientation may be determined by calculating the direction of the mean normal to the desired outline at the intersection zones $Q_{11}$-$Q_{12}$, $Q_{21}$-$Q_{22}$, i.e. the direction that combines, on average, the two normal vectors at the two intersection zones.

At this stage, and as can be seen in FIG. 3, it can nevertheless happen that a new interference zone $Q'_{11}$-$Q'_{12}$ subsists that needs to be detected before blocking the ophthalmic lens.

For this purpose, during seventh and eighth steps E7 and E8, the calculation and control device 100 increments the value N stored in the counter by one and then verifies whether the new value N is less than a predetermined threshold $N_0$.

The purpose of these two steps is to ensure that the iterative method of determining a lens blocking point does not loop indefinitely. In this example, once one hundred tests have been tried ($N_0$=100), it is assumed that there is no suitable blocking position for the lens and that the grinder 200 is therefore not capable of shaping the ophthalmic lens 10 to have the desired outline 11.

In this example, since the value stored in the counter N is equal to 2, the calculation and control device 100 implements above-mentioned steps E4 to E8 once more in order to determine whether it is possible to shape the ophthalmic lens with the desired outline 11 when the lens is in its new blocking position $P_N$ and using the intended tools 220, 230, and 231.

As shown in FIG. 3, this shaping is once more not possible since an intersection zone $Q'_{11}$-$Q'_{12}$ appears between the desired outline 11 and the inner cutting limit 12 associated with the large grindwheel 220.

Consequently, the calculation and control device 100 repeats above-mentioned steps E4 to E8 once more.

If no final blocking position $P_F$ is found after one hundred iterations, then the calculation and control device 100 displays an error message on the screen 102 informing the optician that it is not possible to shape the ophthalmic lens using the grinder 200. It also displays an image of the desired outline 11 that includes, in red, the portion(s) of the outline where there is a danger of interference problems. Under such circumstances, the optician may possibly intervene by modifying the displayed shape of the desired outline on the screen so as to increase it in the vicinity of the red zone. Thus, the calculation and control device 100 may once more attempt to find a final blocking point $P_F$ that is suitable.

In contrast, if the calculation and control device 100 finds a final blocking position $P_F$ in which the zones of the desired outline 11 for shaping with the grindwheel 220 or the wheel 231 do not intersect the inner cutting limit 12 and in which the zones A-B and C-D of the desired outline 11 for shaping with the cutter 230 do not intersect the inner cutting limit 13, then the optician proceeds to block the ophthalmic lens 10 in this final blocking position $P_F$. In other words, once the position of the desired outline 11 has been determined in the frame of reference of the ophthalmic lens 10, the blocking accessory 215 is stuck onto the front optical face 14 of the ophthalmic lens 10 at the final blocking point $P_F$ as identified relative to the desired outline 11.

The ophthalmic lens 10 fitted with its blocking accessory 215 is then blocked between the two shafts 211 of the grinder 200 in order to be shaped therein so as to have the desired outline 11.

At the end of those various operations, the ophthalmic lens 10 shaped with the desired outline 11 is thus suitable for being fitted to the selected eyeglass frame if it is of the rimmed or half-rimmed type.

In contrast, if the eyeglass frame is of the rimless type, it is necessary to make drill holes or notches in the lens so that the bridge and the corresponding temple of the eyeglass frame can be attached thereto.

The drill holes are generally made in the solid material of the lens by means of a drill bit provided on the grinder 200, extending along a determined axis. The position of this axis is identified relative to the desired outline 11 and its orientation relative to the lens is selected so as to be orthogonal to the front face of the lens where the hole is drilled.

The notches form indentations in the edge face of the ophthalmic lens 10. Consequently, they could be made equally well by the cutter 230 or by the drill bit. They could even be made directly while shaping the lens, although that is not the subject matter of the present description. On the contrary, in this example, these notches and drill holes are made after the ophthalmic lens has been shaped, while the lens is still blocked between the shafts 211 of the grinder 200.

In order to avoid any interference between the tool carrier of the cutter or of the drill bit and the shafts 211 while drilling or notching the lens, the calculation and control device 100 then advantageously implements additional steps consisting in:

i) acquiring the positions of the edges of the notches or of the drill holes relative to the desired outline 11;

ii) verifying that the edges of the notches or of the drill holes, after the desired outline has been repositioned relative to the final blocking position $P_F$, do not present any intersections with the inner cutting limit associated with the drill bit (or the cutter); and if such an intersection is detected, iii) determining a new final blocking position $P_F'$ that is offset from the final blocking position $P_F$ that was found initially and that is such that firstly the desired outline 11 repositioned relative to the new final blocking position $P_F'$ does not present any intersection with the inner cutting limit associated with the drill bit (or with the cutter), and secondly the edges of the notches or of the drill holes do not present any intersection with said inner cutting limit.

Thus, the new final blocking position $P_F'$ is selected in such a manner as to avoid any interference between the tool carrier and the shafts 211 both during shaping and during drilling or notching the ophthalmic lens.

In step i), the positions of the edges of the notches or of the drill holes are acquired in projection onto the mean plane of the ophthalmic lens (shown in FIG. 3). It should be observed here that in this projection the edges of the front and rear openings of each drill hole are generally slightly offset, since the drill axis is generally not parallel to the projection axis used. The edge in question then corresponds preferably to the combined outline encompassing the projections of both the front and the rear openings of the drill hole in the mean plane of the ophthalmic lens.

Steps ii) and iii) are implemented using a method identical to that described above, consisting in offsetting the final blocking point $P_F$ until a new final blocking point $P_F'$ is found that satisfies the required conditions.

At the end of those various operations, it can happen that the ophthalmic lens is subjected to other machining operations by the grinder 200. By way of example, provision may be made for engraving specific zones of interest of the lens, such as the periphery of its front face, by using the free end of the cutter 230 or a diamond point provided for this purpose.

Under such circumstances, and in the same manner as for the drill holes, it is then possible, while calculating the position of the final blocking point $P_F$, to implement additional steps for verifying that there is no risk of interference occurring between the tool carrier of the cutter and the shafts 211 for blocking the lens while the lens is being engraved.

The present invention is not limited in any way to the implementation described and shown, and the person skilled in the art knows how to make any variation within the spirit of the invention.

In particular, provision may be made for the method of determining the position of the final blocking point $P_F$ not to be iterative, but rather to consist in considering a plurality of alternative blocking positions, e.g. one hundred of them, and then in determining for each of those alternative blocking positions whether the zones of the desired outline 11 for shaping using the grindwheel 220 or the wheel 231 intersect the inner cutting limit 12 and whether the zones A-B and C-D of the desired outline 11 for shaping using the cutter 230 intersect the inner cutting limit 13.

Thereafter, if none of those alternative blocking positions satisfies both conditions, the calculation and control device displays an error message on the screen.

In contrast, if only one of the alternative blocking positions satisfies both conditions, then that blocking position is selected as being the final blocking position at which it is appropriate to fasten the blocking accessory on the lens.

Finally, if at least two alternative blocking positions satisfy both conditions, then the blocking position that is selected as the final blocking position is the position amongst those alternative blocking positions that is the closest to the boxing center.

It can be understood that the shift performed by each point of the lens when the lens blocking shafts 211 pivot through one degree is not the same when the lens is blocked at the boxing center and when the lens is blocked at a distance therefrom. Consequently, selecting the blocking point that is the closest to the boxing center makes it possible to conserve lens machining conditions that are close to conventional machining conditions.

In a variant, the selected blocking point may be the point that is the closest to the center of gravity (or "barycenter") of the desired outline 11 (or in a variant, closest to the center of the initial circular outline of the ophthalmic lens).

It can be understood that during shaping, the farther away the point being machined is from the blocking point of the lens, the greater the magnitude of the blocking torque between the lens and the blocking accessory. Consequently, selecting the blocking point that is closest to the center of gravity of the desired outline 11 makes it possible to reduce any risk of the lens slipping relative to its blocking accessory, and consequently any risk of losing the frame of reference of the ophthalmic lens. In this way, there is no need to use a blocking accessory of large diameter specifically for the purpose of avoiding any such slip.

In another variant, provision may be made for the inner cutting limits to be acquired, not in the form of three-dimensional surface envelopes, but on the contrary in the form of two-dimensional linear envelopes, e.g. in the form of simple circles such as the circles drawn in FIG. 3.

In another variant, provision may be made for all of the described calculations to be performed, not by the calculation and control device 100 of the grinder 200, but on the contrary by the calculation unit of the centering and blocking appliance used by the optician.

In this variant, before the lens is machined to have the desired outline 11, the calculation unit then transmits to the grinder 200 the final blocking position $P_F$ in such a manner as to enable the grinder 200 to take account of information specifying that the ophthalmic lens 10 is not blocked at its boxing center $P_1$, but rather at some other point that is distinct from the boxing center.

In another implementation of the method of the invention, provision may be made for the ophthalmic lens to be shaped with a machine tool that presents a given axis of rotation and a diameter that varies along said axis of rotation. In particular, provision may be made to use a cutter that presents a first end portion that is held by the tool carrier, a central portion that is substantially cylindrical and that is used for shaping the ophthalmic lens, and a second end portion that is free, of diameter greater than the diameter of the central portion and serving to chamfer the ophthalmic lens.

In this implementation, it can be understood that the free end portion of the cutter then runs the risk of interfering with the blocking shafts 211 while the central portion of the cutter is being used to perform lens shaping operations. The two portions of the cutter then behave like two distinct tools that are located side by side. It is then possible to define two inner cutting limits for that single tool, each limit being associated with a respective one of the two portions of the cutter.

In another implementation of the invention, provision may be made for the initial blocking point of the ophthalmic lens not to be the boxing center of the desired outline, but rather the optical center of the ophthalmic lens, or its center of gravity.

The invention claimed is:

1. A method of shaping an ophthalmic lens (10) for eyeglasses to have a desired outline (11) by means of a machining device (200) including a blocking support (210) for the ophthalmic lens (10) and at least one first machining tool (220) that is rotatable about a first axis (A3) that is movable relative to the blocking support (210), the method comprising the steps of:

a) obtaining an inner cutting limit (12) of said first machining tool (220), defined in a frame of reference of the machining device (200);

b) defining an initial blocking position ($P_1$) for the ophthalmic lens (10) and its desired outline (11) on the blocking support (210) in the frame of reference of the machining device (200);

c) calculating whether at least a fraction of the desired outline (11), when positioned using the initial blocking position ($P_1$), presents a non-zero intersection ($Q_{21}$-$Q_{22}$) with said inner cutting limit (12);

d) defining as a final blocking position ($P_F$), either the initial blocking position ($P_1$) without change if the intersection calculated in step c) is zero, or else, a blocking position that is modified relative to the initial blocking position ($P_1$) so that the desired outline (11) as repositioned to the modified blocking position does not present any intersection with the inner cutting limit (12) associated with the first tool;

e) blocking the ophthalmic lens (10) on the blocking support (210) in the final blocking position ($P_F$); and f) shaping the ophthalmic lens (10) with the desired outline (11) using at least the first machining tool (220).

2. A method according to claim 1, wherein:

the machining device (200) has a plurality of machining tools (220, 230, 231), and at least two distinct machining tools (220, 230) are selected, including said first tool (220) and at least one other tool (230) rotatable about an axis (A6) that is movable relative to the blocking support (210), each tool (220, 230) being for machining a portion associated therewith of the desired outline (11);

in step a), obtaining, for each machining tool (220, 230), an inner cutting limit (12, 13) defined in a frame of reference of the machining device (200), the inner cutting limit (12) of the first tool (220) being distinct from the inner cutting limit (13) of the other tool;

in step c), calculating, for each machining tool (220, 230), whether the portion that is associated therewith of the desired outline (11), as positioned using the initial blocking position ($P_1$), presents any non-zero intersection ($Q_{11}$-$Q_{12}$, $Q_{21}$-$Q_{22}$) with the inner cutting limit (12, 13) associated with the machining tool (220, 230) under consideration;

in step d), defining as the final blocking position ($P_F$), either the unchanged initial blocking position ($P_1$) if the intersections calculated in step c) are zero, or else a blocking position that is modified relative to the initial blocking position ($P_1$) so that the desired outline (11) as repositioned using the modified blocking position does not present any intersection with the inner cutting limits (12, 13) that are associated respectively with the different machining tools (220, 230); and in step f), shaping the lens with the desired outline (11) using the different machining tools (220, 230), a first portion of the desired outline (11) being shaped with said first machining tool (220), and the other portion of the desired outline (11) being shaped with said other machining tool (230).

3. A method according to claim 1, wherein, if the intersection ($Q_{11}$-$Q_{12}$, $Q_{21}$-$Q_{22}$) calculated in step c) is non-zero, step d) comprises the following substeps:

d1) determining an alternative blocking position ($P_N$) different from the initial blocking position ($P_1$);

d2) calculating, for each machining tool (220, 230) and for said alternative blocking position ($P_N$), whether at least a portion of the desired outline (11) as repositioned using said alternative blocking position ($P_N$) presents a non-zero intersection ($Q'_{11}$-$Q'_{12}$) with the inner cutting limit (12, 13) associated with the machining tool (220, 230) under consideration; and d3) repeating steps d1) and d2) so long as step d2) gives a non-zero intersection result ($Q'_{11}$-$Q'_{12}$).

4. A method according to claim 1, wherein, if the intersection ($Q_{11}$-$Q_{12}$, $Q_{21}$-$Q_{22}$) calculated in step c) is non-zero, step d) comprises the following substeps:

d'1) determining a plurality of alternative blocking positions different from the initial blocking position ($P_1$);

d'2) calculating, for each tool and for each alternative blocking position, whether at least a portion of the desired outline as positioned using the alternative blocking position under consideration presents a non-zero intersection with the inner cutting limit associated with the tool under consideration; and d'3) selecting the modified blocking position from said alternative blocking positions.

5. A method according to claim 4, wherein, in step d), the modified blocking position is defined from amongst the alternative blocking positions as the blocking position of the lens on the blocking support that is the closest to the initial blocking position.

6. A method according to claim 4, wherein, in step d), the modified blocking position is defined from amongst the alternative blocking positions as the blocking position of the lens on the blocking support that is the closest to the position of the center of gravity of the desired outline (11).

7. A method according to claim 1, wherein, in step c), a radius segment (S1, S2) is calculated around the initial blocking position ($P_1$) that is situated inside said intersection ($Q_{11}$-$Q_{12}$, $Q_{21}$-$Q_{22}$) and that presents the greatest length, and wherein, in step d), the modified blocking position ($P_N$) is the result of shifting the position of the initial blocking position ($P_1$) in the direction of said radius segment (S1, S2).

8. A method according to claim 7, wherein said shift is through a distance equal to the length of said radius segment.

9. A method according to claim 7, wherein, for step c) giving as its result at least two non-zero intersections ($Q_{11}$-$Q_{12}$, $Q_{21}$-$Q_{22}$) between the desired outline (11) and each inner cutting limit (12, 13), there is calculated, for each intersection ($Q_{11}$-$Q_{12}$, $Q_{21}$-$Q_{22}$), the radius segment (S1, S2) about the initial blocking position ($P_1$) that is situated inside the intersection ($Q_{11}$-$Q_{12}$, $Q_{21}$-$Q_{22}$) under consideration and that presents the greatest length, and wherein, in step d), the modified blocking position ($P_N$) results from at least one combination of shifts of the initial blocking position ($P_1$) along the directions of said radius segments (S1, S2) respectively associated with said at least two intersections ($Q_{11}$-$Q_{12}$, $Q_{21}$-$Q_{22}$).

10. A method according to claim 1 applied to an ophthalmic lens for being drilled or notched by means of a second machining tool in order to be mounted on a rimless frame, the method comprising:

a step of obtaining an inner cutting limit of said second machining tool defined in the frame of reference of the machining device;

a step of acquiring the positions of the edges of the notches or of the drill holes in a frame of reference associated with the desired outline;

between steps d) and e), a calculation step of detecting whether, when the desired outline is repositioned at the final blocking position, the edges of the notches or drill holes present a non-zero intersection with the inner cutting limit associated with said second tool; and if an intersection is detected, a step of determining a new final blocking position distinct from said final blocking position and such that firstly the desired outline, when repositioned using the new final blocking position, does not present any intersection with the inner cutting limit associated with the second tool, and secondly the edges of the notches or drill holes do not present any intersection with said inner cutting limit.

11. A method according to claim 1, wherein the inner cutting limit (12, 13) of each machining tool (220, 230) depends on the shape of the machining tool (220, 230) or of a tool carrier (240) carrying said machining tool (220, 230), and also on the shape of the blocking support (210) of the ophthalmic lens (10).

12. A method according to claim 1, wherein the inner cutting limit (12, 13) of each machining tool (220, 230) depends on the angle formed between the axis of rotation (A6) of the tool under consideration and a blocking axis (A2) about which the ophthalmic lens (10) turns relative to the machining tools (220, 230) while it is being shaped in step f).

13. A method according to claim 1, wherein the inner cutting limit (12, 13) of each machining tool (220, 230) is obtained from a registry in which each record contains an identifier of a machining tool (220, 230) and an inner cutting limit (12, 13) associated with said machining tool (220, 230).

14. A method according to claim 1, wherein steps a) to d) are implemented by a calculation device distinct from said machining device (200), and includes, between steps d) and f), a step of transmitting the final blocking position ($P_F$) from the calculation device to the machining device (200).

* * * * *